United States Patent [19]

Einhorn

[11] 4,196,890

[45] Apr. 8, 1980

[54] SECURITY FENCE

[75] Inventor: Gunther D. Einhorn, Bulawayo, Southern Rhodesia

[73] Assignee: Electroreps S.A. (Pty) Ltd., Johannesburg, South Africa

[21] Appl. No.: 959,158

[22] Filed: Nov. 9, 1978

[30] Foreign Application Priority Data

Nov. 9, 1977 [ZA] South Africa ..... 77/6695

[51] Int. Cl.[2] ..... E04H 17/02

[52] U.S. Cl. ..... 256/2; 256/10

[58] Field of Search ..... 256/1-10

[56] References Cited

U.S. PATENT DOCUMENTS

| | | | |
|---|---|---|---|
| 617,596 | 1/1899 | McDaniel | 256/32 |
| 642,109 | 1/1900 | Green | 256/8 UX |
| 762,645 | 6/1904 | May | 256/32 |
| 2,350,290 | 5/1944 | Moore | 256/10 |
| 2,422,012 | 6/1947 | Greenlee | 256/10 |
| 2,437,613 | 3/1948 | Redpath | 256/10 X |

FOREIGN PATENT DOCUMENTS

| | | | |
|---|---|---|---|
| 906529 | 5/1945 | France | 256/3 |
| 1450187 | 9/1976 | United Kingdom | 256/32 |

*Primary Examiner*—Andrew V. Kundrat

*Attorney, Agent, or Firm*—Benjamin J. Barish

[57] ABSTRACT

A security fence is described comprising a plurality of barbed wires supported on spaced posts and extending in a generally parallel horizontal direction to the ground surface, alternate wires being supported on opposite sides of each post in the manner of a basket weave configuration such that the wires in plan view cross each other. Alternate wires are connected to a source of electric power, with the intermediate wires being earthed.

8 Claims, 5 Drawing Figures

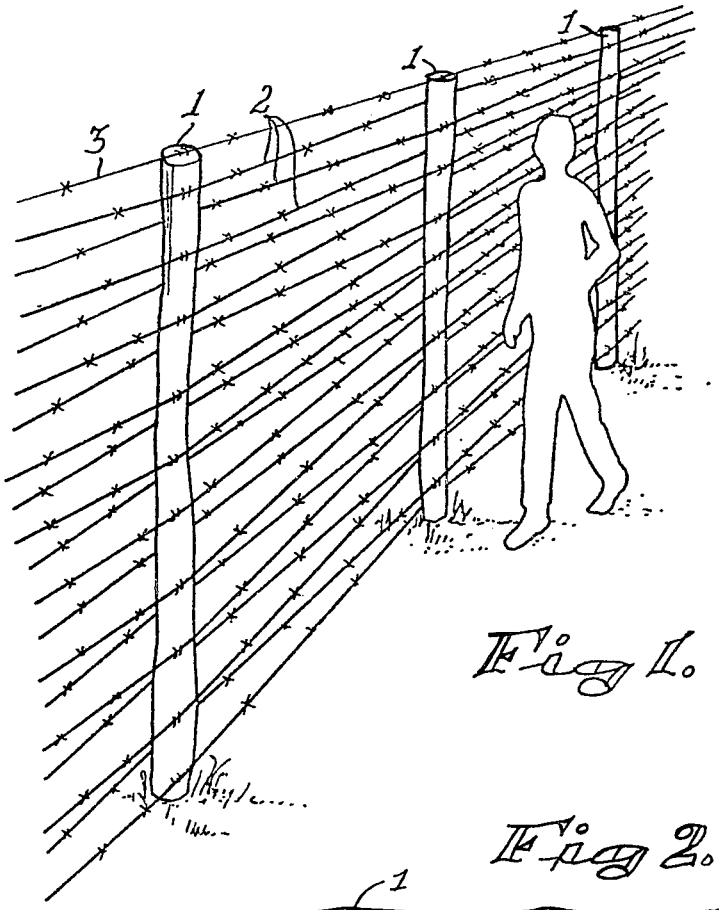
Fig 1.
Fig 2.
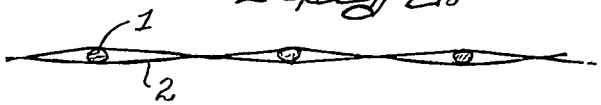
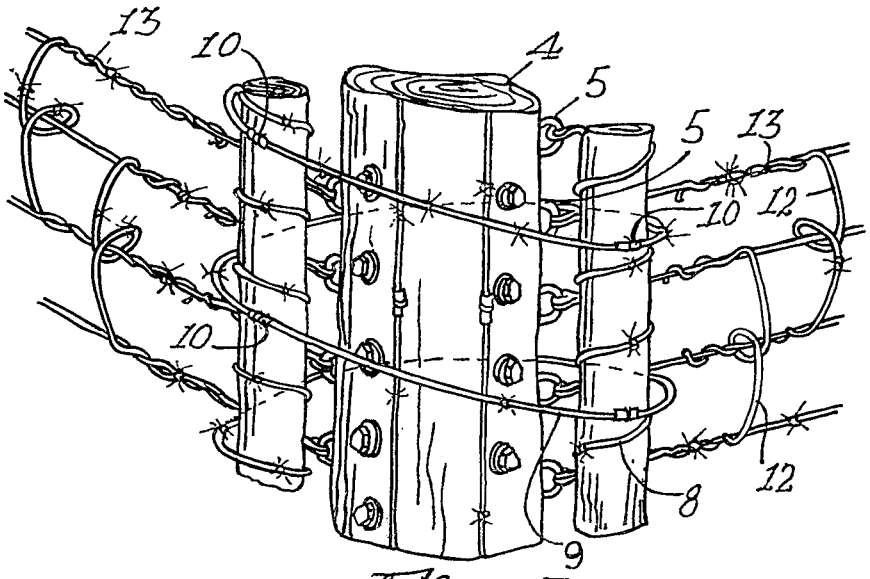
Fig 3.

SECURITY FENCE

BACKGROUND OF THE INVENTION

This invention relates to a security fence of the type used to enclose restricted areas of land or the like to inhibit unauthorised entry thereto.

More particularly, but not exclusively, the invention relates to a security fence which embodies an alarm for warning persons if the fence is tampered with by unauthorised persons in certain manners.

It is the object of this invention to provide a security fence which will make passage therethrough more difficult than heretofore. Another object is to provide a security fence which will sound an alarm if an attempt is made to penetrate it by climbing over it, by spreading its wires, or by cutting its wires, while at the same time minimizing false alarms.

SUMMARY OF THE INVENTION

In accordance with this invention there is provided a security fence comprising a plurality of wires supported on spaced posts and extending in a generally parallel direction to the ground surface, the wires being supported on opposite sides of each post such that the wires in plan view cross each other. The wires are barbed wires, and the posts are also wrapped with barbed wires.

Further features of the invention provide for alternate wires to be located on opposite sides of each post in the manner of a basket weave configuration; for alternate wires to be connected to a source of electric power with the intermediate wires being earthed in a suitable manner; and for an alarm circuit to be connected to the wires in order to activate an alarm if any of the wires connected to the electrical power supply is cut or if any of them is contacted with an earth wire.

Yet another feature provides for the alternate wires to be electrically connected together in series, by means of separate lengths of stiff wire each of which is looped around the intermediate wire without touching it.

The invention also provides for corner and other posts to be optionally wrapped with barbed wire, and for the wires to be attached to the corner posts by means of eyebolts bolted therethrough. Barbed wire wrapped strand posts are provided parallel and adjacent to a line of eyelets of eyebolts in a corner post, so as to inhibit use of the eyelets of the eyebolts as climbing holds.

BRIEF DESCRIPTION OF THE DRAWINGS

A preferred embodiment of the invention is described below with reference to the accompanying drawings, in which:-

FIG. 1 is a perspective view of part of a security fence and illustrates three posts thereof;

FIG. 2 is a plan view of part of the security fence;

FIG. 3 is an isometric view of part of a corner post in a security fence including strand posts;

DESCRIPTION OF A PREFERRED EMBODIMENT

Referring to FIG. 1, a security fence comprises a suitable number of posts 1 spaced apart and arranged to follow the general path which the fence is to follow.

The post 1 can conveniently be wooden poles suitably buried in the ground and optionally anchored therein by means of a concrete foundation.

The required number of strands of barbed wire 2 which extend substantially parallel to the ground surface are supported by the posts. Conveniently, and because wooden poles are electrically insulating by nature, the wires are simply stapled to the wooden poles. As provided by this invention some of the wires will be secured to one side of each post and other wires to the opposite side. In the described preferred embodiment, alternative wires are secured to opposite sides of the post, and each wire is arranged to be secured to the opposite side of the adjacent posts. In this manner the wires form a type of basket weave configuration which is illustrated in plan view, in FIG. 2.

A further strand of barbed wire 3 (FIG. 1.) is stapled to the top ends of each post.

Since the wires are barbed wire, the basket weave configuration makes it extremely difficult to part a pair of adjacent wires sufficiently to enable a person to pass therethrough. The reason for this is that the barbs interfere with each other as a result of the wires crossing each other in plan view. Thus as one wire is lifted the barbs thereon will interfere with the barbs on the next adjacent wire to inhibit or at least make extremely difficult the operation of parting the pair of wires sufficiently to enable a person to pass therethrough. It will be understood that both the lower and upper wire of a pair thereof which are to be parted will interfere with their next adjacent wires thus increasing the difficulty in effectively parting the wires.

Figure 4:
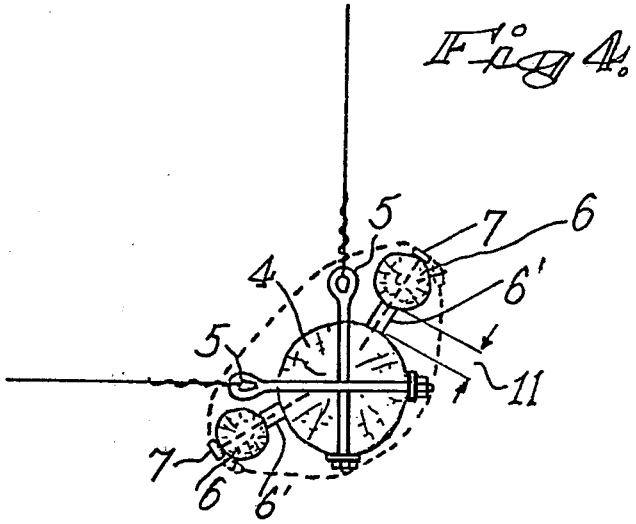
FIG. 4 is a plan view of a corner post in FIG. 3.

The various strands of wire are secured to corner posts 4 (FIG. 3) by means of eyebolts 5. The eyebolts are located through diametrical holes drilled in the post, and bolted tight. The eyebolt holes are drilled coaxially with the line that the wire strands are to take, adjacent holes being at right angles to each other (FIG. 4).

In order to help prevent the use of the eyelets of the eyebolts as climbing holes, strand post 6 (FIG. 4) are secured to the corner posts 4. These strand posts are adjacent and parallel to each vertical line of eyebolts. They are spaced from the corner post by a short length of metal tubing 6' and secured by nails 7 or the like driven through the strand post 6' and hollow of the tubing 6 into the corner post.

Each strand post 6 is wrapped with barbed wire 8 and barbed wire 9 is wrapped around each corner post 4 and the adjacent strand posts 6. This wrapping wire is secured to the strand and corner posts by staples 10 at suitable points on the posts. The spacing of the strand posts from a corner post will depend on the accessibility of the eyebolt eyelets for climbing holds, but is preferably 50–70 mm indicated at 11 (FIG. 4).

The illustrated fence is suitable connected to an alarm circuit such that when two adjacent wires touch each other, or when certain wires are cut, an alarm is given. To this end each alternate wire is electrified and every wire in between such alternate wires is connected to earth. By means of simple circuitry as soon as one of said alternate wires is cut an alarm will be sounded, and also if any of the earth wires touch an electrified wire an alarm is similarly given.

Figure 5:
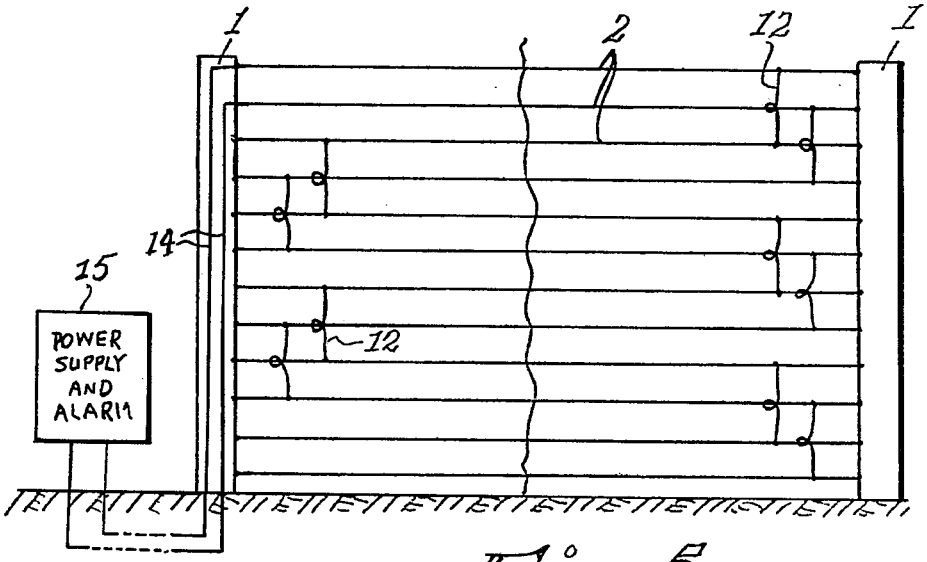
FIG. 5 is a schematic diagram of electrical connections of alternate wires in a security fence.

The electrical connections of each alternate wire is shown schematically in FIG. 5. Here, each alternate wire is connected by means of a stiff barbed wire 12 looped around each intermediate wire without touching it so as to connect the alternate wires in series. There are a plurality of such barbed wires 12 each connected to a pair of alternate wires at the opposite ends in a staggered relationship to form a series circuit therewith, so that a severance of one of the wires will break the continuity of the series circuit. The barbed wire loops are connected to the alternate wires by twisting their ends around their respective alternate wires, as illustrated at 13 in FIG. 3. It will be appreciated that only a slight movement of a strand will bring it into electrical contact with a connecting wire looped around it. The distance from a wire strand to the wire looped around it is preferably between 50 and 75 mm.

The electricity supply is brought to each post from a power supply and alarm unit 15 (FIG. 5) by underground cable and may be supplied to the wire strands by lengths of barbed wire 14 which take power off the cable and deliver it to the top two strands of the fence. These barbed wire lengths 14 are insulated from the wrapping or other wire by suitable means (not shown).

Where ground conditions are soft, or where the wire strands are to be highly tensioned, corner or other posts may have diagonal supporting struts. These struts may have concrete foundations which may be part of a concrete foundation for the main post.

An electrified gate (not shown), connected to the alarm system may also be provided. This gate would have alternate strands of wire electrified in a similar manner to the fence.

It will be understood that in accordance with general practice the wire strands will be spaced by a small distance of not more than about 14 cm and generally not less than about 9 cm. The height of the fence may vary with requirements, but is preferably about 2 m. It will also be understood that the posts could be made of conducting material in which case the electrified wires will be insulated therefrom in any suitable manner.

As one example, alternate wires could be supplied by unit 15 with 25 microamperes of electricity, with unit 15 including a continuity measuring circuit for measuring the continuity of both the current-carrying wires and the earth wires for detecting a severance of either, and also including a current measuring circuit measuring the current through the electrified wires for detecting a drop in the current therethrough upon its coming into contact with an earth wire by a spreading apart of the wires. The looped stiff wires 12 make the fence particularly sensitive to attempts to climb over it, since their loops would thereby be brought into contact with wires passing through them.

It will be appreciated that other types of arrangements of wires could be used provided that some of these cross each other in plan view so that the barbs on the barbed wire will interfere with each other when a person attempts to part a pair of adjacent wires with a view to providing an aperture sufficiently large for a person to pass through.

What is claimed is:

1. A security fence comprising a plurality of barbed wires supported on spaced posts and extending in a generally parallel direction to the ground surface, the wires being supported on opposite sides of each post such that the wires in plan view cross each other, said posts being wrapped with barbed wire.

2. A security fence as claimed in claim 1, in which alternate wires are located on opposite sides of each post in the manner of a basket weave configuration.

3. A security fence as claimed in claim 1 in which alternate wires are connected to a source of electric power with the intermediate wires being earthed, the alternate wires being connected in series from the source of electric power to an alarm circuit adapted to activate an alarm if any of the wires connected to the electrical power supply is cut or if any of them is contacted with an earth wire.

4. A security fence as claimed in claim 3, in which alternate wires are electrically connected by means of a plurality of further wires each connected to a pair of alternate wires at their opposite ends in a staggered relationship to form a series circuit therewith, each of the further wires being looped around the respective intermediate wire without touching it.

5. A security fence as claimed in claim 1, in which the wires are secured to corner posts by means of eyebolts bolted therethrough.

6. A security fence as claimed in claim 5, in which barbed wire wrapped strand posts are secured to corner posts parallel and adjacent to a line of eyelets of eyebolts.

7. A security fence as claimed in claim 1, in which the posts are wooden posts.

8. A security fence as claimed in claim 1, in which the posts are metal posts, and the wires attached thereto are electrically insulated therefrom.

* * * * *